US010155613B1

(12) United States Patent
Bovis

(10) Patent No.: US 10,155,613 B1
(45) Date of Patent: Dec. 18, 2018

(54) FOOD PACKAGING SYSTEMS WITH FINGER GLOVES

(71) Applicant: SMTM Technology, LLC, San Mateo, CA (US)

(72) Inventor: Nick Bovis, San Mateo, CA (US)

(73) Assignee: SMTM Technology, LLC, San Mateo, CA (US)

( * ) Notice: Subject to any disclaimer, the term of this patent is extended or adjusted under 35 U.S.C. 154(b) by 0 days.

(21) Appl. No.: 15/690,712

(22) Filed: Aug. 30, 2017

(51) Int. Cl.

| | |
|---|---|
| ***B65D 75/00*** | (2006.01) |
| ***B65D 75/58*** | (2006.01) |
| ***A41D 13/08*** | (2006.01) |
| ***A41D 27/08*** | (2006.01) |

(52) U.S. Cl.
CPC ..... *B65D 75/5805* (2013.01); *A41D 13/087* (2013.01); *A41D 27/08* (2013.01)

(58) Field of Classification Search
USPC .... 206/216, 218, 541, 542, 548; 383/4, 200, 383/207, 209
See application file for complete search history.

(56) References Cited

U.S. PATENT DOCUMENTS 3,902,509 A * 9/1975 Tundermann ..... A61C 15/02 433/142
4,677,697 A * 7/1987 Hayes ..... A41D 19/0068 2/159
4,951,815 A * 8/1990 Ulbrich ..... A61B 50/33 206/213
5,065,863 A * 11/1991 Moyet-Ortiz ..... A61B 42/40 206/210
5,704,670 A * 1/1998 Surplus ..... A41D 19/0075 2/159
5,714,208 A * 2/1998 Ferrell ..... B29C 73/10 156/94
5,816,440 A * 10/1998 Shields ..... B65D 83/0805 221/45
5,819,765 A * 10/1998 Mittiga ..... A46B 5/04 132/309
5,947,275 A * 9/1999 Hess ..... B65D 75/5855 206/210
6,203,080 B1 * 3/2001 Surplus ..... A41D 19/0075 2/159
2008/0264808 A1 * 10/2008 Gostt ..... A45F 4/02 206/216
2012/0076440 A1 * 3/2012 Gallagher ..... B65D 33/20 383/4
2014/0091006 A1 * 4/2014 Fogel ..... A61J 1/00 206/572
2016/0376084 A1 * 12/2016 Wein ..... B65D 81/363 206/541

* cited by examiner

*Primary Examiner* — Jacob K Ackun
(74) *Attorney, Agent, or Firm* — Richards Patent Law P.C.

(57) ABSTRACT

The present disclosure provides a disposable food storage bag including a pair of disposable finger gloves that can be separated from the food storage bag and worn to prevent a user's fingers from directly contacting the food content inside the storage bag. In an example, the disposable finger gloves can be positioned at and around the top portion of the food storage bag, wherein the removal the disposable finger gloves (e.g., tearing according to perforation) creates an opening in the food storage bag for access to the inner contents.

17 Claims, 5 Drawing Sheets

FOOD PACKAGING SYSTEMS WITH FINGER GLOVES

BACKGROUND OF THE INVENTION

The present subject matter relates generally to systems to cover a user's fingers while picking up to food to prevent direct contact between a user's fingers and the food.

People often decide against eating foods such as chicken wings, flavored chips and barbequed pork ribs in order to avoid getting sauce on their hands and potentially their clothing. Even when conditions are acceptable for eating messy foods, people tend to avoid touching anything while their hands have sauce on them thereby precluding them from consuming beverages until they have finished eating the entire serving and have cleaned their hands. In addition, people often avoid certain foods eaten with a person's fingers that include colorful chips or sauce that results in temporarily dying the person's fingers, wherein even after washing their hands the color remains and can color other items they touch in the future.

Various systems have been created to address a portion of these issues. For example, metal or plastic tongs used to select food from a container, such as at a bakery or buffet. In addition, disposable paper based finger food tongs have been formed by folding a sheet of paper or plastic material to form opposite pockets with mid-facing pocket openings, which are not sealed for sanitary use.

However, even with the conventional finger gloves such tongs must be purchased or provided separately, prior to eating or handling food. For example, disposable finger gloves or sanitary gloves can be provided stacked in a container that allows a user to wear before handling the food. However, many people do not have access to finger gloves, much less a container of finger gloves at the time of eating. Further, few users would think to pack finger gloves in a personal bag, for example when traveling, in case of an event arising that would require the use of such tongs.

Accordingly, there is a need for finger gloves that are conveniently provided at the event of use, wherein the tongs protect a user's fingers from directly contacting the food while consuming.

BRIEF SUMMARY OF THE INVENTION

The present disclosure provides a type of finger gloves that enables users to comfortably manipulate food without the user's fingers coming into direct contact with the food. Various examples of the methods are provided herein.

The present disclosure provides a disposable food storage bag system including a food storage bag and a pair of disposable finger gloves that can be separated from the food storage bag and worn to prevent a user's fingers from directly contacting the food content inside the storage bag (e.g., chips, crackers, chex mix, candy, chocolates, etc.). In an example, the disposable finger gloves can be positioned at and around the top of the food storage bag, wherein the removal the disposable finger gloves (e.g., tearing according to perforation) creates an opening in the food storage bag for access to the inner contents. Alternatively, the finger gloves can be attached to any portion of the outer surface of the food storage bag, wherein the finger gloves can be removed without opening the food storage bag. In yet another example, the finger gloves can be included inside the food storage bag, such as in a separate wrapped package.

The finger gloves can be formed by a strip of paper or other flexible disposable material, wherein both ends of the strip include a pocket for at least one of a user's fingers and thumb to be inserted, respectively. The strip can be folded about its middle so that its pocketed ends form jaws and such that each pocket is located on the outer surface of the strip, wherein the inner surface of the finger gloves is used to handle the food substance when worn by the user by inserting a finger, or fingers, into the one pocket, and a thumb into the other pocket.

In an example, the food storage bag comprises a food storage bag including a body assembled to form an enclosed container, wherein the body is joined at a top edge and a bottom edge, wherein the body includes a removable top portion and a bottom portion, wherein separating the removable top portion from the bottom portion creates a top opening in the food storage bag enabling a user to access the interior of the food storage bag, wherein the removable top portion includes a finger glove strip including a strip body having distal ends, wherein each distal end includes at least one pocket to accommodate at least one finger or thumb of the user In an example, the food storage bag comprises a food storage bag including a body assembled to form an enclosed container; and a finger glove strip removably attached to an outer surface of the body of the food storage bag, wherein the finger glove strip includes a strip body having distal ends, wherein each distal end includes at least one pocket to accommodate at least one finger or thumb of the user.

In an example, the food storage bag comprises a food storage bag including a body assembled to form an enclosed container, wherein the body is joined at a top edge and a bottom edge, wherein the body includes a removable top portion and a bottom portion, wherein separating the removable top portion from the food storage bag creates a top opening in the food storage bag enabling a user to access to the interior of the food storage bag, wherein the removable top portion includes at least two finger sleeves, wherein each finger sleeve includes at least one pocket to accommodate at least one finger or thumb of the user An advantage of the present system is to provide finger gloves that are provided with the food product for convenient use and packaging.

An advantage of the present system is to provide finger gloves that do not have to be purchased or packed separately, but provided with the specific food product that the finger gloves will be used.

A further advantage of the present system is to provide finger gloves suitable for use in handling food, which can be produced at a cost sufficiently low to make it practicable for the user to throw them away after only one use.

An advantage of the present system is to provide finger gloves that can be manufactured concurrently with the food storage bag.

An advantage of the present system includes reducing manufacturing materials in contrast to systems that manufacture the finger gloves separately. By using the finger gloves as part of the food storage bag, less materials and resources are used than would be if the food storage bag and finger gloves are manufactured separately.

Another advantage of the present systems is unproved hygienic food handling as with the present system the user does not have direct contact with the food being handled except for directly eating the food instead of touching the food.

Another advantage of the present system is the reduced likelihood of spreading disease causing viruses and bacteria by preventing a user from contaminating his food with his or her dirty fingers.

Another advantage of the present systems is providing a protective strip to maintain a sterile food strip before use.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

The present disclosure provides a type of eating utensil that enables users to comfortably manipulate food without the user's fingers coming into direct contact with the food. Various examples of the methods are provided herein.

The present disclosure provides a disposable food storage bag including a pair of disposable finger gloves that can be separated from the food storage bag and worn to prevent a user's fingers from directly contacting the food content inside the storage bag. In an example, the disposable finger gloves can be positioned at and around the top portion of the food storage bag, wherein the removal the disposable finger gloves (e.g., tearing according to perforation) creates an opening in the food storage bag for access to the inner contents. Alternatively the finger gloves can be attached to any portion of the outer surface of the food storage bag, wherein the finger gloves can be removed (e.g., peeled off) without opening the food storage bag. In yet another example, the finger gloves can be included inside the food storage bag, such as in a separate wrapped package.

Figure 1:
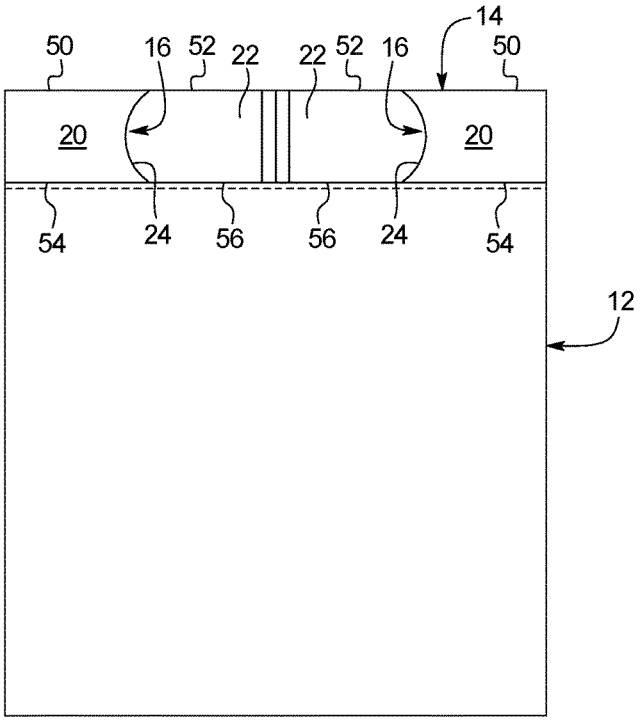
FIG. 1 is a front view of a food storage bag system including the finger glove strip.

As shown in FIG. 1, the food packaging system 10 includes a disposable food storage bag 12 and a finger glove strip 14. The food storage bag 12 and finger glove strip 14 can be made of the same or different materials. In an example, the finger glove strip 14 can be made of any polymeric material, paper, plastic, among others. In an example, the finger glove strip 14 can be composed of a flexible polymer material, such as latex, to provide more flexibility and give during use to prevent puncture and provide increased mobility.

Figure 2:
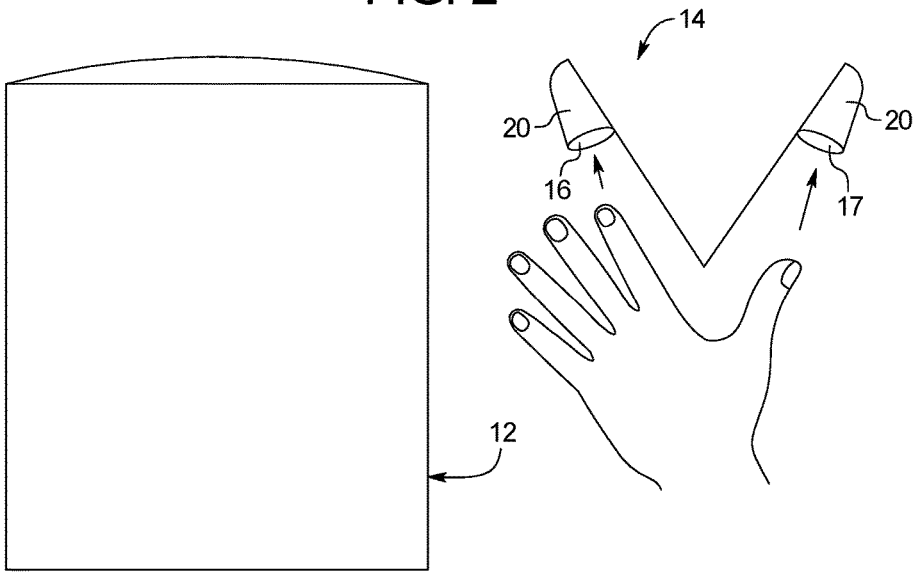
FIG. 2 is a perspective view of an example of the finger glove strip removed from the food storage bag.

As shown in FIG. 2, the finger glove strip 14 forms a portion of the outer circumference of the top of the food storage bag 12. In an example, the removal of the finger glove strip 14 creates an opening in the food storage bag 12. Alternatively, the finger glove strip 14 can be adhered to a portion of the outer surface of the food storage bag 12. For example, the finger glove strip 14 can be removeably attached to the outer surface of the food storage bag 12 by any suitable means, including, but not limited to, adhesive, glue, perforation, tape, and tabs, among others.

As shown in FIG. 2, the finger gloves 14 can be formed by a strip of material wherein each end includes a pocket 16. The pockets 16 can be any suitable size. In an example, the size of the pockets are suitable to house a portion of at least one finger or thumb. The width of the pocket 16 can be suitable to have one to four fingers inserted within the pocket. In an example, a first pocket can have a width suitable to house a portion of one to four fingers and the second pocket suitable to house a portion of a user's thumb. The length of the pockets 16 can cover at least one finger digit to a length that covers three finger digits when the fingers are inserted within the pocket. The first pocket and second pocket can be the same of different sizes.

In an example, the finger gloves 14 are formed from a single strip of disposable material, however, any suitable material is contemplated. Each pocket 16 has a front wall 20 which constitutes a folded-over extension of the respective end of the strip body 22 and which is secured at the sides 24 by a band of suitable adhesive. The finger glove strip can include a single sheet of material, wherein the pockets 16 are formed by folding the ends of the strip body 22 back over itself and sealing a pocket top edge 50 to a portion of the body strip top edge 52, and a pocket bottom edge 54 to a portion of the body strip bottom edge 56.

The pockets 16 can be any suitable shape including square, rectangular, conical, among others. The strip body 22 is flexible to be bent or folded about its midpoint, so that the pocket 16 ends of the strip body 22 form jaws or tongs to handle food products. The arrangement is such that the finger gloves 14 can worn by the user inserting a finger or fingers into a first pocket 16 and a thumb into a second pocket 17. On pressing the ends of the strip together the fingers and thumb, inserted in the respective pockets 1647, gripping pressure can thereby be applied through the finger gloves 14 to the product to be handled.

In an example, the open edge 24 of the front wall 20 of the pocket 16 lays flat against the strip body 22 before use. Alternatively, the open edge 24 of the front wall 20 can be removably attached (e.g., removably adhered) to the front wall 20 until the user is ready to remove the finger gloves 14 from the food storage bag 12 for use or wear. For example, the open edge 24 can be separable from the front wall 20 by perforation, wax, adhesion, glue, among others, before use.

Figure 3A:
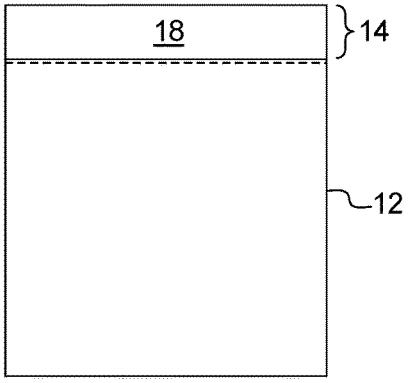
FIGS. 3A-3D are front views of an example of a food storage bag system including a finger glove strip, wherein the food tong strip is protected by a protective strip that can be removed before using the finger gloves.
Figure 3B:
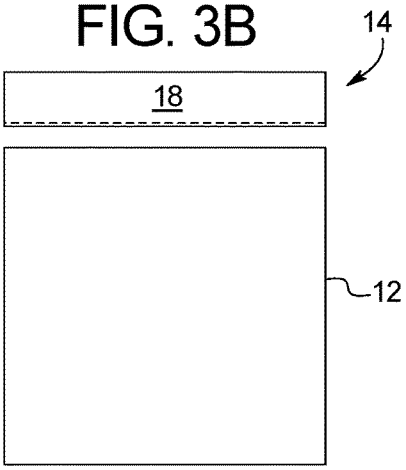
Figure 3C:
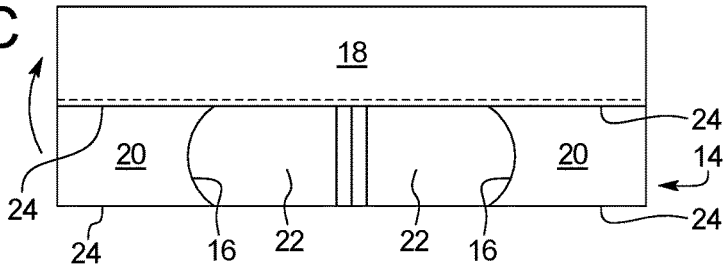
Figure 3D:
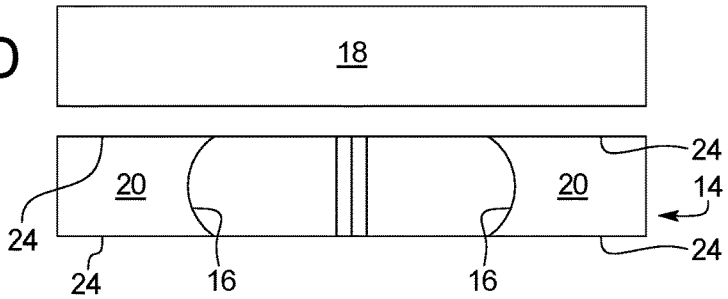

As shown in FIGS. 3A-3D, the finger gloves 14 can be protected from external exposure before use by a protective strip 18. As a result of using the protective strip 18, the finger gloves 14 can remain sanitary before use. Therefore, users can handle, transport, and pack the food storage bag 12 without fear of contaminating (dirtying, soiling, etc.) the finger gloves 14. In an example, as shown in FIG. 3A, the protective strip 18 folds over the entire outer surface of the finger glove strip 14. In an example, both a top edge and bottom edge of the protective strip 18 is removeably attached to a top edge and bottom edge of the finger gloves 14. In an example, the edges of the finger gloves 14 and protective strip 18 can be removeably attached by perforation, adhesion, glue, tabs, or any other suitable method. FIG. 3B depicts the removal of the finger gloves 14 and folded over protective strip 18 from the food storage bag 12. FIG. 3C depicts unfolding the protective strip 18 by removing the bottom edge of the protective strip 18 from the bottom edge of the finger gloves 14 to expose the finger gloves 14. Lastly, the protective strip 18 can be removed from the top edge of the finger gloves 14, as shown in FIG. 3D, such that a user can wear the finger gloves 14.

Alternatively, or in addition to, the protective strip 18 can be adhered to the outer surface of the finger gloves 14, such that before use, the protective strip 18 can be easily peeled off to expose the finger gloves 14 for use. In an example, only a portion of the finger gloves 14 are covered by the protective strip 18. For example, two smaller protective strips 18 can be used to protect the pockets 16 or ends of the tongs to assure sanitary conditions for use.

Figure 5A:
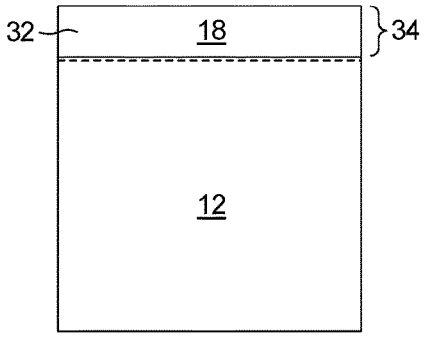
FIGS. 5A-5H are perspective views of an example of a food storage bag system including a removable top portion including a top back portion and a top front portion that can include the finger glove strip, wherein the food tong strip is protected by a protective strip that can be removed along with the top back portion before using the finger gloves.
Figure 5B:
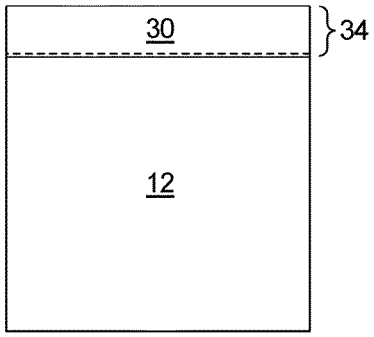
Figure 5C:
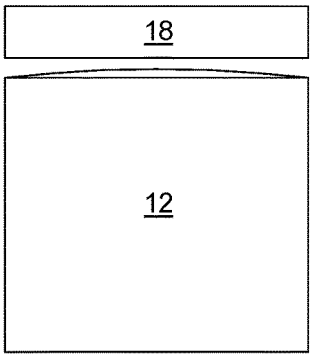
Figure 5D:
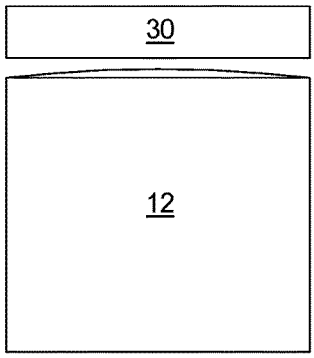
Figure 5E:
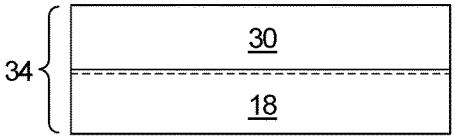
Figure 5F:
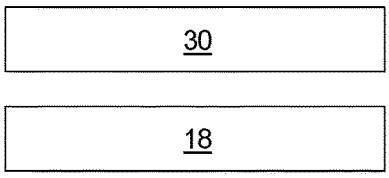
Figure 5G:
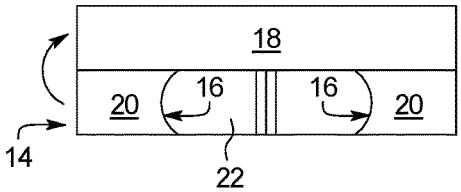
Figure 5H:
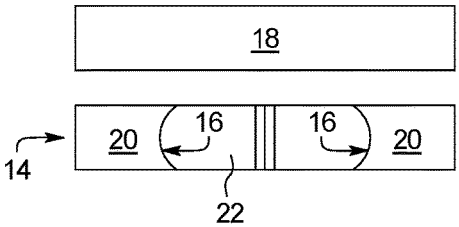

FIGS. 5A-5H illustrate an example wherein the food storage bag 12 includes a removable top portion 34, wherein the removal or separation of the removable top portion 34 from the remaining food storage bag 12 provides an opening in the food storage bag 12. In the example, the top removable portion of the bag 34 includes a back top portion 30 (as shown in the back view in FIG. 5B) and a front top portion 32 (as shown in the front view in FIG. 5A), wherein the front top portion 32 includes the finger gloves 14 covered by the protective strip 18 on the front side of the food storage bag 12. FIGS. 5C-5D illustrate the step of removal of the top removable portion 34 from the food storage bag 12, wherein FIG. 5C is the front view and FIG. 5D is the back view. The back top portion 30 and the front top portion 32 can be separated from each other, for example by perforation or adhesion, as shown in FIGS. 5E-5F. As explained previously herein, the protective strip 18 can be removed from the finger gloves 14 for use.

Figure 6A:
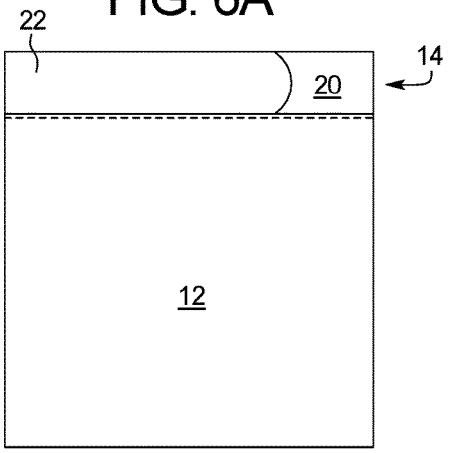
FIGS. 6A-6F are perspective views of an example of a food storage bag system including a finger glove strip that spans the entire removable top portion.
Figure 6B:
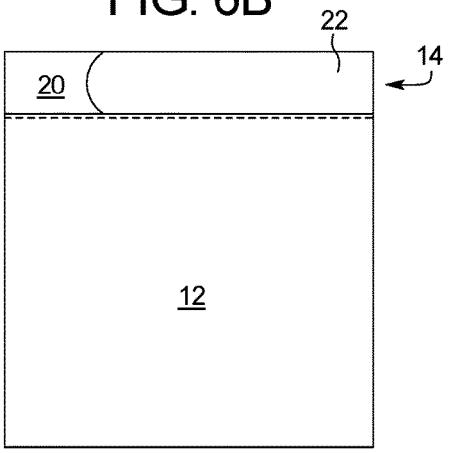
Figure 6C:
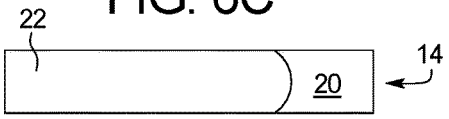
Figure 6D:
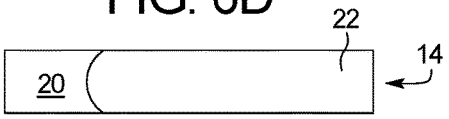
Figure 6E:
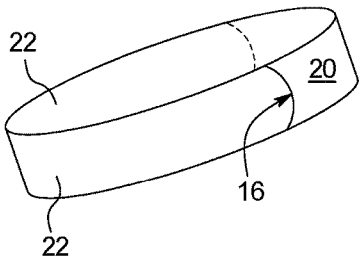
Figure 6F:
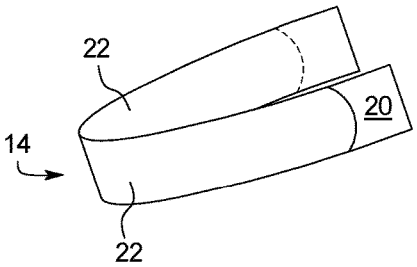

In yet another example, shown in FIGS. 6A-6E, the finger gloves 14 can form the removable top portion 34 wherein the finger gloves 14 extend around the entire circumference of the food storage bag 12. In such case, the end edge both pockets 16 can be removably joined together, and separated before use. FIGS. 6A-6B illustrate the front and back sides respectively. Once the top portion 34 is removed, the front and back views of the finger gloves 14 can be seen in FIGS. 6C-6D. FIGS. 6E-6F illustrates a perspective view of the finger gloves 14 before and after the pockets 16 have been separated from each other, forming useable tongs. In addition, although not shown, it is contemplated that a protective strip 18 can cover the entire exposed surface of the finger gloves 14, wherein the protective strip 18 can be removed before use to assure a sanitary surface of the tongs before use.

In an example, the inner surface of the finger gloves 14 can include a textured surface to provide a grabbing surface to assist in holding the food product between the finger gloves 14 while in use. The textured surfaces may be crimped, embossed, or formed in the inner surface of the finger gloves 14, or may be provided on adherable stickers or substrates attachable to the inner surface of the finger gloves 14.

Figure 4:
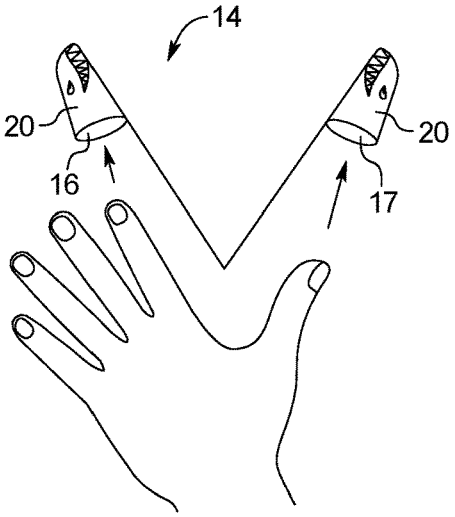
FIG. 4 is a perspective view of an example of finger gloves including a decorative element on the pockets.

In an example, as shown in FIG. 4, the appearance of the finger gloves, while being worn by the user, also allows the distal ends of the finger gloves to be manipulated by the user so as to create the illusion of an animated structure. For example the pockets 16 and strip body 22 can be enhanced by artwork or other indicia to create a puppet that appears to open and close at s mouth.

Figure 7A:
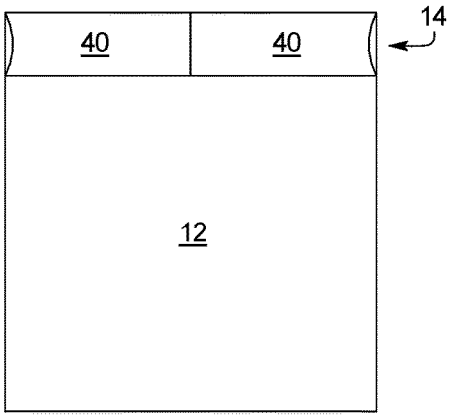
FIGS. 7A-7D are perspective views of an example of a food storage bag system including a finger glove comprising at least one finger sleeve.
Figure 7B:
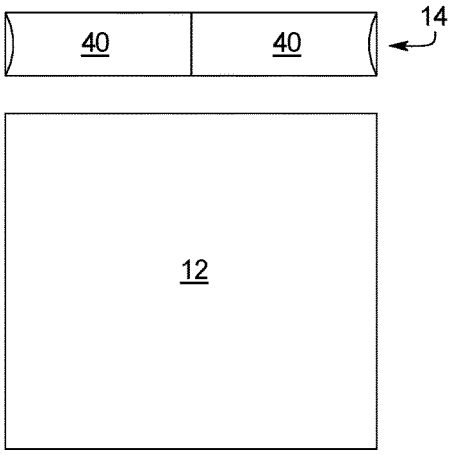
Figure 7C:
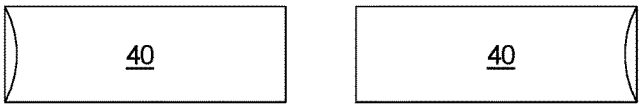
Figure 7D:
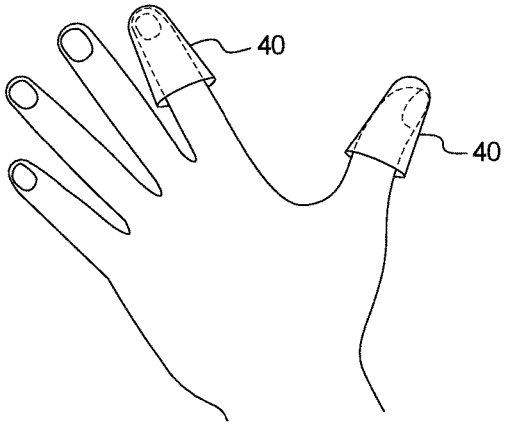

In yet another example, as shown in FIGS. 7A-7D, instead of the finger gloves 14 including a strip body 22 with two pockets 16 on each end, the finger gloves 14 can include one or more finger sleeves 40 that are not connected to each other while in use. In other words, the system 10 can include a food storage bag 12 with at least two or more finger sleeves 40 attached to or incorporated in the storage bag 12, wherein a user can wear the finger sleeves on at least one finger and thumb. As shown in FIG. 7B, the finger tongs 14 can be removed from the food storage bag 12, wherein the finger tongs 14 includes one to four connected finger sleeves 40, wherein the finger sleeves 40 are connected via perforation or adhesion. FIG. 7C depicts the finger sleeves 40 separated from each other and ready for use to be worn by the user, as shown in FIG. 7D.

In contrast to the example where the finger glove strip are incorporated or attached to the structure of the food storage bag 12, the finger glove strip can be provided inside the bag 12 such as in a disposable protective enclosure. In such case, the user can open the food storage bag 12, remove the packaged finger gloves 14 from the disposable protective enclosure, and wear the finger gloves 14 while contacting the food.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

I claim:

1. A food storage bag comprising:

a food storage bag including a body assembled to form an enclosed container, wherein the body is joined at a top edge and a bottom edge, wherein the body includes a removable top portion and a bottom portion, wherein separating the removable top portion from the bottom portion creates a top opening in the food storage bag enabling a user to access the interior of the food storage bag, wherein the removable top portion includes a finger glove strip including a strip body having distal ends, wherein each distal end includes at least one pocket to accommodate at least one finger or thumb of the user.

2. The food storage bag of claim 1, wherein the finger glove strip includes a single sheet of material, wherein the pockets are formed by folding the ends of the strip body back over itself and sealing a pocket top edge to a portion of the body strip top edge and joining a pocket bottom edge to a portion of the body strip bottom edge.

3. The food storage bag of claim 1, wherein each pocket includes a front wall including an unsealed front wall edge and three sealed edges to the food strip body, wherein the front wall edge forms a pocket opening to receive a user's finger or thumb.

4. The food storage bag of claim 3, wherein the front wall edge is removably attached to the food strip body.

5. The food storage bag of claim 1, wherein the removable top portion includes a protective strip positioned over an external surface of the finger glove strip, wherein the protective strip is removably attached to the finger glove strip.

6. The food storage bag of claim 1, wherein the removable top portion includes a back top portion and a front top portion, wherein the front top portion includes a protective strip positioned over an external surface of the finger glove strip, wherein the back top portion is removably attached to the front top portion, wherein the protective strip is removably attached to the finger glove strip.

7. The food storage bag of claim 1, wherein an external surface of the pockets include an animal image.

8. The food storage bag of claim 1, wherein an external surface of the food strip body include an animal image.

9. The food storage bag of claim 1, wherein the finger glove strip is removable from the food storage bag by perforation.

10. A food storage bag comprising:

a food storage bag including a body assembled to form an enclosed container, wherein the body is joined at a top edge and a bottom edge, wherein the body includes a removable top portion and a bottom portion, wherein separating the removable top portion from the food storage bag creates a top opening in the food storage bag enabling a user to access to the interior of the food storage bag, wherein the removable top portion includes at least two finger sleeves, wherein each finger sleeve includes at least one pocket to accommodate at least one finger or thumb of the user.

11. The food storage bag of claim 10, wherein each pocket includes three sealed edges and an opening to receive a user's finger or thumb.

12. The food storage bag of claim 10, wherein the removable top portion includes a protective strip positioned over an external surface of the finger sleeves, wherein the protective strip is removably attached to the finger sleeves.

13. The food storage bag of claim 10, wherein the two finger sleeves are formed of a single sheet of material including a strip body, wherein the pockets are formed by folding the ends of the strip body back over itself and sealing a pocket top edge to a portion of the body strip top edge and joining a pocket bottom edge to a portion of the body strip bottom edge.

14. The food storage bag of claim 13, wherein the two finger sleeves can be separated from each other via perforation in the strip body.

15. The food storage bag of claim 10, wherein each pocket includes a front wall including an unsealed front wall edge and three sealed edges to the food strip body, wherein the front wall edge forms a pocket opening to receive a user's finger or thumb.

16. The food storage bag of claim 10, wherein an external surface of the pockets include an animal image.

17. The food storage bag of claim 10, wherein the removable top portion is removable from the food storage bag by perforation.

* * * * *